United States Patent [19]

Kuindersma

[11] 4,419,545

[45] Dec. 6, 1983

[54] ELECTRET TRANSDUCER

[75] Inventor: Pieter I. Kuindersma, Eindhoven, Netherlands

[73] Assignee: U.S. Philips Corporation, New York, N.Y.

[21] Appl. No.: 282,620

[22] Filed: Jul. 13, 1981

[30] Foreign Application Priority Data

Jul. 30, 1980 [NL] Netherlands ..... 8004351

[51] Int. Cl.[3] ..... H04R 19/00; H04R 1/28

[52] U.S. Cl. ..... 179/111 E; 181/184; 181/186; 307/400

[58] Field of Search ..... 307/400; 179/111 E; 181/143, 184, 186

[56] References Cited

U.S. PATENT DOCUMENTS 3,833,770 9/1974 Atoji et al. ..... 179/111 E

OTHER PUBLICATIONS

Leo L. Beranek, *Acoustics,* (McGraw Hill, New York, 1954), p. 134.

Paul M. D'Amico and Philip Kuhn, "Three New Noise Cancelling Electret Communication Devices", *J. Audio Eng. Soc.,* vol. 24, p. 118, (Mar. 1976).

*Primary Examiner*—G. Z. Rubinson

*Assistant Examiner*—Danita R. Byrd

*Attorney, Agent, or Firm*—Robert T. Mayer; Bernard Franzblau

[57] ABSTRACT

An electret transducer comprising a diaphragm (3) arranged between first (1 or 1') and second electrodes with at least one electrode (2) arranged at some distance from the diaphragm as a stationary electrode formed with holes (5). An air gap (4) is formed between the diaphragm (3) and said electrode (2). In the case of one air gap the air gap width d and the area A (7) enclosed by four holes which are situated nearest each other in said electrode (2) are selected so that the following equation is satisfied $$75 < 6\eta \frac{A}{d^3} < 600 \text{ (Ns/m}^3 \text{ or } mks \text{ rayls)}$$

where $\eta$ is the dynamic viscosity of the air in the air gap.

In the case of an air gap on each side of the diaphragm, the air gap widths $d_1$ and $d_2$ and the said areas $A_1$ and $A_2$ are selected to satisfy the equation $$75 < 6\eta \frac{A_1}{d_1^3} + 6\eta \frac{A_2}{d_2^3} < 600 \text{ (Ns/m}^3\text{)}$$

8 Claims, 6 Drawing Figures

2a 2b 2c

ELECTRET TRANSDUCER

Figure 1:
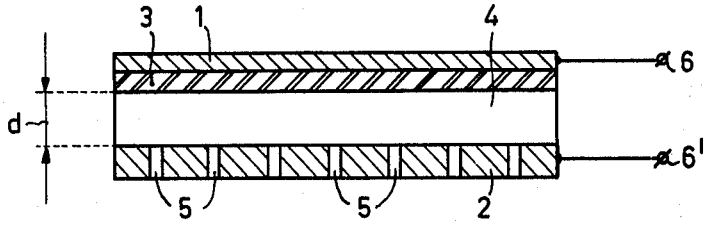

The invention relates to an electret transducer comprising a diaphragm and a first and a second electrode. The electrodes are disposed one on each side of the diaphragm and at least one electrode is spaced from the diaphragm as a stationary electrode so that at least a first air gap is formed between the diaphragm and said stationary electrode. The stationary electrode is formed with holes which are substantially uniformly distributed over its surface area.

The invention also relates to a headphone comprising an electret transducer in accordance with the invention.

An electret transducer of the type mentioned in the opening paragraph is known from U.S. Pat. No. Re. 28,420, see FIGS. 2, 3 and 3*a*. The known transducer is provided with a single stationary electrode formed with holes. However, the invention is not limited to this type of transducer but is equally applicable to electret transducers provided with two stationary electrodes, each formed with holes, the one stationary electrode together with the diaphragm forming an air gap on the one side of the diaphragm and the other stationary electrode together with the diaphragm forming an air gap on the other side of the diaphragm.

It is known to influence the frequency response and sensitivity of an electret transducer by a suitable choice of the pattern of the holes in the stationary electrode, that is by the choice of the spacing between and the diameter of the holes and by the choice of the width of the air gap between the diaphragm and a stationary electrode. In this respect, frequency response is to be understood to mean the amplitude response of the transducer as a function of the frequency.

However, known electret transducers frequently exhibit sharp peaks in their frequency response owing to the natural resonances of the diaphragm or they frequently exhibit a sensitivity which is too low.

It is an object of the invention to provide an electret transducer having an improved frequency response or sensitivity.

To this end the electret transducer according to the invention is characterized in that the impedance Z acting on the diaphragm, which is determined by means of the formula $$Z = 6\eta \sum_{i=1}^{n} \frac{A_i}{d_i^3},$$

satisfies the requirement $75 < Z < 600$ (Ns/m$^3$), where $n=1$ if only one electrode forms an air gap with the diaphragm, and $n=2$ if electrodes on each side of the diaphragm each form an air gap therewith, $\eta$ is the dynamic viscosity of air, $d_i$ the width of the air gap between the relevant electrode(s) and the diaphragm, and $A_i$ is the size of the area enclosed by four adjacent holes which are disposed at the corners of a quadrilateral in the relevant electrode(s).

The step in accordance with the invention is based on the recognition that the acoustic impedance acting on the diaphragm is mainly determined by the viscosity of the air in the air gap between the diaphragm and a stationary electrode.

By experiment a formula can be found for the specific acoustic impedance which demonstrated that said impedance is determined by the air-gap width and the size of the area enclosed by four adjacent holes which are disposed at the corners of a quadrilateral.

For a definition of the term specific acoustic impedance, which impedance is expressed in the units Ns/m$^3$ or mks rayls, reference is made to "Acoustics" by L. L. Beranek, McGraw Hill, page 11.

Controlling said impedance has been found to be a major factor in optimizing the operation of the electret transducer in accordance with the invention. Specifically, it was found that for a choice of said impedance between the values 75 and 600 Ns/m$^3$, the advantage is obtained that the occurrence and amplitude of low frequency peaks in the frequency response of the transducer is reduced compared with an impedance which is below 75 Ns/m$^3$, and that an overdamped system which causes the sensitivity to become too low is avoided, if the impedance is below 600 Ns/m$^3$.

If the electret transducer is constructed as a balanced system with a stationary electrode and an associated air gap on each side of the diaphragm, the two impedances associated with the two air gaps should be added to each other, n being equal to 2. If only one electrode forms an air gap with the diaphragm and the other electrode is arranged on the diaphragm as a conductive layer, then n is equal to 1. The air gap width of this one air gap and the size of the area enclosed between four adjacent holes disposed at the corners of a quadrilateral in the stationary electrode should now be selected so that the impedance of this single air gap is situated in the specified range.

Furthermore, it is possible to provide the stationary electrode forming an air gap with the diaphragm with a slide so that the area of the holes in said stationary electrode and thus the area $A_i$ is variable.

This step makes it possible to adapt the behaviour of the transducer as regards the frequency response and sensitivity within certain limits.

A headphone in accordance with the invention is characterized in that the headphone comprises an electret transducer in accordance with the invention. U.S. Pat. No. 3,645,354 (FIG. 4) shows the mounting of an electroacoustic transducer, e.g. an electrodynamic or electrostatic transducer (which may include an electret), in a headphone. In headphones the gap width is generally selected to be much smaller than for electret transducers employed as loudspeakers. In the case of electret transducers in the form of loudspeakers the deflections of the diaphragm are substantially greater in order to obtain a high acoustic output signal, which necessitates the use of large gap widths. In electret transducers used in headphones, where the amplitude of the acoustic output signal can be much smaller, the gap width may therefore be selected to be substantially smaller, so that a higher sensitivity of the electret system can be obtained. In the known headphones the size of the areas enclosed between four adjacent holes disposed at the corners of a quadrilateral in the stationary electrode generally proves to be too large, so that too high an impedance is acting on the diaphragm of the transducer. By selecting the sizes so that the impedance is situated in the specified range, it is found that the operation of the electret transducers for headphones can be improved.

Figure 2:
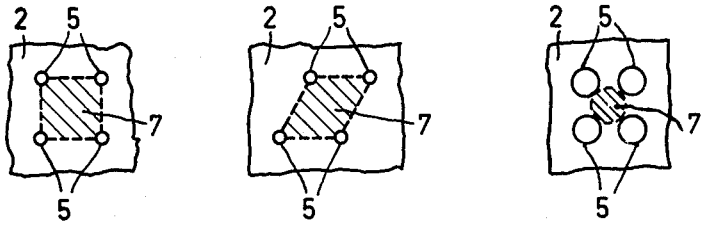
Figure 3:
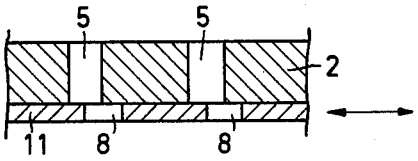
Figure 4:
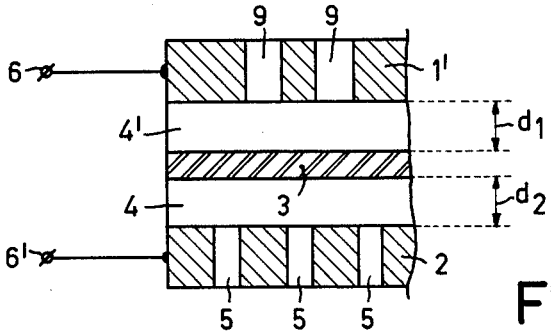

The idea underlying the invention will be described, by way of example, with reference to the accompanying drawings in which:

FIG. 1 shows an embodiment of an electret transducer in accordance with the invention, FIG. 2, in FIGS. 2*a*, 2*b* and 2*c*, shows three examples of a part of the stationary electrode of the electret transducer in which holes are formed, FIG. 3 shows a part of a stationary electrode provided with a slide, and FIG. 4 shows another embodiment of an electret transducer in accordance with the invention, constructed as a balanced system.

FIG. 1 shows an embodiment of an electret transducer provided with a charged diaphragm 3 made of an insulating polymer material, a first electrode 1 and a second electrode 2. The first electrode 1 is arranged on the diaphragm 3 in the form of an electrically conductive layer. The second electrode 2 is a stationary electrode (also called back-electrode) which together with the diaphragm 3 forms an air gap 4 having a width d. The air gap communicates with the external air via holes 5 in the second electrode. When the diaphragm 3 is made to vibrate by acoustic waves, a voltage proportional to the amplitude of the vibrations is obtained on the terminals 6—6'. Conversely, an electric signal applied to the terminals 6—6' will cause the diaphragm to vibrate so that the diaphragm produces an acoustic signal. The gap width d and the dimensions of the area A enclosed by four adjacent holes 5 which are disposed at the corners of a quadrilateral in the stationary electrode 2 and are represented by the hatched parts 7 in FIGS. 2*a*, 2*b* and 2*c*, which Figures show a part of the stationary electrode 2, should now be selected so that the following equation is satisfied $$75 < 6\eta(A/d^3) < 600 \text{ (Ns/m}^3 \text{ or mks rayls)} \quad (1)$$

where $\eta$ is the dynamic viscosity of the air in the air gap and is substantially equal to $1.8\times10^{-5}$ Ns/m$^2$ (see "Acoustics" by L. L. Beranek, McGraw Hill, page 135).

FIGS. 2*a*, 2*b* and 2*c* show how the size of the area enclosed by the four adjacent holes 5, which are disposed at the corners of a quadrilateral, can be determined for a number of configurations of the stationary electrode 2.

FIG. 3 shows a single stationary electrode 2 provided with a slide 11 which is movable in the direction of the arrow. The slide 11 is formed with holes 8 which in a specific position of the slide coincides with the holes 5 of the stationary electrode 2. By moving the slide 11 in one of the indicated directions the effective cross-sectional area of the holes 5 can be reduced. As a result of this, the area A between four adjacent holes which are disposed at the corners of a quadrilateral is increased, so that the impedance acting on the diaphragm becomes adjustable.

It is alternatively possible to make the holes 8 in the slide 11 of different sizes, so that e.g. in a first position of the slide 11 all holes 5 are open and in a second position of the slide the holes are alternately open and closed.

FIG. 4 shows a part of an electret transducer in the form of a balanced system. On each side of the diaphragm 3 there is arranged a stationary electrode 1' and 2, respectively, each formed with holes 9 and 5 respectively, which electrodes each form an air gap 4' and 4 respectively with the diaphragm 3. The air gaps have a width $d_1$ and $d_2$ respectively. Especially during reproduction such a symmetrical system of FIG. 4 has the advantage that a linear relationship is obtained between acoustic waves and electric signals. This is in contrast to the embodiment shown in FIG. 1. The gap widths $d_1$ and $d_2$ and the dimensions of the areas $A_1$ and $A_2$ enclosed by the respective groups of four holes 9 and 5 in the respective stationary electrodes 1' and 2 should be selected so that the following equation is complied with:

$$75 < 6\eta\frac{A_1}{d_1^3} + 6\eta\frac{A_2}{d_2^3} < 600 \text{ (Ns/m}^3) \quad (2)$$

where $\eta$ is the dynamic viscosity of the air in the air gap.

Especially if the electret transducer in accordance with the invention is employed in headphones it is essential that equation (1) or (2) be satisfied. In the case of electret transducers used in headphones the air gap width, owing to the substantially smaller deflections of the diaphragm required for these applications, is made much smaller than for example in the case of transducers employed as loudspeakers. This is because loudspeakers require substantially larger deflections in order to obtain a suitable acoustic output power so that the air gap width should be substantially greater.

The use of much smaller air gap widths in headphones then requires that said areas between the four holes in the stationary electrodes should also be reduced in order to assure that formula (1) or (2) is satisfied.

It is to be noted that the invention is not limited to the embodiments shown, but is equally applicable to embodiments in which for example the holes have a different cross-section or embodiments which differ from those shown with respect to features which are irrelevant to the invention.

What is claimed is:

1. An electret transducer comprising: a diaphragm, first and second electrodes disposed one on each side of the diaphragm with at least one electrode being spaced from the diaphragm as a stationary electrode so as to form a first air gap between the diaphragm and said stationary electrode, said stationary electrode being formed with holes which are substantially uniformly distributed over its surface area, and wherein an acoustic impedance Z acting on the diaphragm is determined by means of the formula $$Z = 6\eta \sum_{i=1}^{n} \frac{A_i}{d_i^3}$$

and satisfies the requirement $75<Z<600$ (Ns/m$^3$), where $n=1$ if only one electrode forms an air gap with the diaphragm, and $n=2$ if electrodes on each side of the diaphragm each form an air gap therewith, $\eta$ is the dynamic viscosity of air, $d_i$ is the width of the air gap between the relevant electrode(s) and the diaphragm, and $A_i$ is the size of the area enclosed by four adjacent holes which are disposed at the corners of a quadrilateral in the relevant electrode(s).

2. An electret transducer as claimed in claim 1, wherein a stationary electrode spaced from the diaphragm includes a slide movable such that the area of the holes in said stationary electrode and thus the area $A_i$ is variable.

3. An electret transducer as claimed in claims 1 or 2 wherein the air gap width $d_i$ and the area size $A_i$ are selected so as to especially adapt the transducer to be mounted within a headphone.

4. An electroacoustic transducer comprising: a vibratory electret diaphragm, a pair of spaced electrodes disposed on opposite sides of said diaphragm with at least one electrode spaced from the diaphragm to form a stationary electrode that defines an air gap between one surface of the diaphragm and said stationary electrode, said stationary electrode having a multiplicity of holes therein uniformly distributed over its surface area, said transducer providing an acoustic impedance Z acting on the diaphragm in which the impedance Z is greater than 75 but less then 600 $Ns/m^3$, where $Z=6\eta(A/d^3)$, $\eta$ is the dynamic viscosity of air in the air gap, d is the width of the air gap between the stationary electrode and the diaphragm, and A is the area on the stationary electrode enclosed by four adjacent holes therein disposed so as to define the corners of a quadrilateral.

5. A transducer as claimed in claim 4 wherein the other one of said electrodes comprises an electrically conductive layer on the other surface of the electret diaphragm opposite said one surface.

6. An electroacoustic transducer comprising: a vibratory electret diaghragm, first and second spaced electrodes disposed on opposite sides of said diaghragm, to form first and second air gaps with the diaghragm, each of said electrodes having a multiplicity of holes therein uniformly distributed over its surface area, said transducer providing an acoustic impedance Z acting on the diaghragm in which the impedance Z is greater than 75 but less than 600 $Ns/m^3$, where $$Z = 6\eta \frac{A_1}{d_1^3} + 6\eta \frac{A_2}{d_2^3}.$$

$\eta$ is the dynamic viscosity of air in an air gap, $d_1$ and $d_2$ are the widths of the first and second air gaps, respectively, and $A_1$ and $A_2$ are the areas on the first and second electrodes, respectively, enclosed by four adjacent holes therein disposed so as to define the corners of a quadrilateral.

7. A transducer as claimed in claim 6 wherein both surfaces of the diaghragm are free of conductive material.

8. A headphone comprising an electret transducer as claimed in claim 1.

* * * * *

UNITED STATES PATENT AND TRADEMARK OFFICE

CERTIFICATE OF CORRECTION

PATENT NO. : 4,419,545

DATED : December 6, 1983

INVENTOR(S) : PIETER I. KUINDERSMA

It is certified that error appears in the above-identified patent and that said Letters Patent is hereby corrected as shown below:

Claim 1, lines 9 and 10 delete "determined by means of" and insert --selected in accordance with--

Claim 6, line 3, after "diaghragm" delete "," (comma)

Signed and Sealed this

*Fifth* Day of *November 1985*

[SEAL]

*Attest:*

DONALD J. QUIGG

*Attesting Officer*

*Commissioner of Patents and Trademarks*